US005689778A

United States Patent [19]

Hayakawa et al.

[11] Patent Number: 5,689,778

[45] Date of Patent: Nov. 18, 1997

[54] IMAGE FORMING APPARATUS

[75] Inventors: Takashi Hayakawa, Soraku-gun; Katsumi Adachi, Ikoma-gun, both of Japan

[73] Assignee: Sharp Kabushiki Kaisha, Osaka, Japan

[21] Appl. No.: 557,974

[22] Filed: Nov. 13, 1995

[30] Foreign Application Priority Data

Dec. 28, 1994 [JP] Japan ..... 6-328767

[51] Int. Cl.[6] ..... G03G 15/02

[52] U.S. Cl. ..... 399/174; 399/168

[58] Field of Search ..... 355/219, 269, 355/270, 296, 298; 399/130, 149, 168, 174, 175, 343, 353, 354

[56] References Cited

U.S. PATENT DOCUMENTS

| | | | |
|---|---|---|---|
| 5,055,882 | 10/1991 | Fushimi | 355/269 |
| 5,119,138 | 6/1992 | Oda et al. | 355/269 |
| 5,148,219 | 9/1992 | Kohyama | 355/219 |
| 5,187,525 | 2/1993 | Fushimi et al. | 355/269 |
| 5,196,892 | 3/1993 | Mitsuaki | 355/269 |

FOREIGN PATENT DOCUMENTS

| | | |
|---|---|---|
| 62-203182 | 9/1987 | Japan . |
| 63-241587 | 10/1988 | Japan . |

*Primary Examiner*—Sandra L. Brase
*Attorney, Agent, or Firm*—David G. Conlin; Brian L. Michaelis

[57] ABSTRACT

An image forming apparatus adopting a cleaningless process using contact-type charging means, includes developer scattering means which is located between the charging means and an exposure position in contact with the surface of an image carrier. For example, the developer scattering means is a conducting brush which scatters, catches and temporarily holds the residual toner on the image carrier. With this structure, even in an image forming apparatus adopting the cleaningless process using the contact-type charging means, the residual toner on the image carrier is scattered and caught by developer catching means before the residual toner reaches the exposure position. Thus, a lowering of the image quality which is caused if the residual toner is patterned by the charging means is prevented, thereby improving the image quality. Consequently, it is possible to provide a small-sized superior image forming apparatus with high maintainability which is capable of recycling the developer and producing an image with high image quality.

29 Claims, 8 Drawing Sheets

IMAGE FORMING APPARATUS

FIELD OF THE INVENTION

The present invention relates to image forming apparatuses such as copying machines and printers, for forming images by an electrophotographic method.

BACKGROUND OF THE INVENTION

In a conventional image forming apparatus employing an electrophotographic method, the imaging process usually includes five steps: a charging step for uniformly charging the surface of a photoreceptor as an image carrier; an exposing step for forming an electrostatic latent image by irradiating the surface of the photoreceptor with light; a developing step for developing the electrostatic latent image into a visible form using toner; a transferring step for transferring a toner image obtained by development to paper; and a cleaning step for removing residual toner on the surface of the photoreceptor.

The charging step is carried out by a charger. The exposing step is performed using a write head. The developing step is executed by a developing device. The transferring step is performed using a transfer device. The cleaning step is performed using a cleaning device including a cleaning blade and a waste toner box. In the cleaning device, residual toner is scraped and removed from the surface of the photoreceptor by pushing the cleaning blade against the surface of the photoreceptor. The removed residual toner is stored and accumulated in the waste toner box, and then discarded.

However, in an image forming apparatus including such a cleaning device, it is necessary to ensure a large storage space therein so as to store the waste toner box, and to periodically perform maintenance so as to dispose of the accumulated waste toner. It is thus impossible to reduce the size of the image forming apparatus and achieve an improvement from the point of view of maintenance.

In order to solve the above problems, the development of a cleaningless process has been actively carried out to provide a developing device with a toner collecting function and to effectively use resources. In the cleaningless process, an electrostatic latent image is formed by performing charging and exposure in a state in which the residual toner remaining after the transferring step adheres to the surface of the photoreceptor. In the developing step, development is carried out by newly supplying toner to the exposed portion of the surface of the photoreceptor from a developing and cleaning device in addition to the residual toner remaining thereon. Meanwhile, the residual toner remaining on an unexposed portion of the surface of the photoreceptor flies toward a developing and cleaning device and is collected in a developer vessel. Namely, cleaning and recycling of the residual toner on the unexposed portion are performed.

The development of the exposed portion and the cleaning of the unexposed portion are simultaneously executed in the developing step based on the following theory. Specifically, in a reversal development method, development is performed by causing the developing and cleaning device to which a voltage lower than the charge potential of the photoreceptor (an unexposed portion) has been applied to supply toner charged in the same polarity to an exposed portion where the surface potential has lowered nearly zero. At this time, the residual toner remaining on the unexposed portion of the photoreceptor flies from the photoreceptor toward the developing and cleaning device because of a potential difference between the photoreceptor and the charger, and is collected in the developer vessel.

Thus, if recycling of the residual toner is possible, the waste toner box and maintenance thereof become unnecessary. As a result, effective use of resources, a reduction in the size of the apparatus and an improvement in terms of maintenance are simultaneously achieved.

However, in the cleaningless process, when the surface of the photoreceptor where the residual toner remaining after the transfer operation still forms the pattern of the previous image moves to the charging section and the exposing section, the surface of the photoreceptor cannot be uniformly charged in the charging section because of the pattern. Additionally, since the exposure is interrupted by the pattern, a clear electrostatic image cannot be formed in the exposing section. Consequently, the pattern remains as a memory image in the next imaging operation, affects the next image, and degrades the image quality, resulting in an unclear image.

In order to solve such a problem, for example, Japanese Publication for Unexamined Patent Application No. 203182/1987 (Tokukaisho 62-203182) and No. 241587/1988 (Tokukaisho 63-241587) disclose image forming apparatuses including disturbing (non-patterning) means between the transfer section and the charging section. With this structure, the pattern formed by the residual toner remaining after the transfer operation is disturbed and scattered on the photoreceptor by the disturbing means before the charging step so as to prevent the formation of a pattern of the residual toner. Namely, the formation of a memory image by the residual toner is prevented.

On the other hand, with respect to a charging device for charging the surface of a photoreceptor in the charging step, the introduction and development of contact-type charging devices have been actively carried out in place of non-contact or discharging-type charging devices because the discharging-type charging devices (a typical example is a corona discharger) suffer from the following drawbacks.

(1) Since a high voltage is required to charge the photoreceptor, the charger becomes larger in size in order to prevent a leakage current.

(2) Since the charging efficiency is low, the power consumption is large.

(3) Since ozone ($O_3$) is generated by the ionization of oxygen molecules in the atmosphere when performing discharging toward the photoreceptor, the performance of the constituent members of the device deteriorates.

(4) Since a device for removing ozone is required in order to protect public health, it is difficult to decrease the size of the main body of the device.

However, in the above-mentioned structure disclosed by Japanese Publication for Unexamined Patent Application No. 203182/1987 and No. 241587/1988, if a contact-type charger which can solve problems (1) to (4) above is used as a charging device in an image forming apparatus performing the cleaningless process for recycling the residual toner, the following new problems arise.

In this structure, the formation of a memory image by the residual toner is prevented by disturbing and scattering (i.e., non-patterning) the pattern of the residual toner remaining after the transfer operation on the photoreceptor using the disturbing means prior to the charging step.

More specifically, as illustrated in FIG. 8, since a photoreceptor 21 comes into contact with a charger 22 in a state in which residual toner Tr adheres to the surface of the photoreceptor 21, the residual toner Tr adheres to the charger 22. The residual toner of the negative polarity which adheres to and is accumulated on the charger 22 is again bounced and accumulated on the photoreceptor 21 by an electric repulsive force generated between the residual toner Tr and the charger 22 with the application of a negative voltage to the charger 22. As a result, despite the non-patterning of the residual toner Tr on the photoreceptor 21 which was performed by the disturbing means before the charging step, a new pattern is formed by the charger 22. If the photoreceptor 21 carrying the new pattern thereon moves to the exposure step, a faulty exposure may occur like the above-mentioned case in which a pattern is formed by the residual toner remaining after the transfer operation. Namely, the pattern formed by the charger 22 functions as a memory image, affects the next image, and degrades the image quality.

Moreover, in this structure, if an alternating current is applied to the charger 22 as shown in FIG. 9, the amount of the residual toner Tr flying from the charger 22 to the photoreceptor 21 is increased and decreased in synchronism with the cycle of the alternating current. More specifically, when the applied voltage to the charger 22 has an absolute value which is smaller than the surface potential of the photoreceptor 21, the negative residual toner Tr adhering to the charger 22 can hardly move back to the photoreceptor 21 because of an electric repulsive force between the residual toner Tr and the charger 22. On the other hand, when the applied voltage to the charger 22 has an absolute value which is larger than the surface potential of the photoreceptor 21, the negative residual toner Tr adhering to the charger 22 receives a large electric repulsive force from the charger 22 and thus easily moves back to the photoreceptor 21. When the applied voltage to the charger 22 becomes peak in the negative direction, the amount of the toner Tr flying to the photoreceptor 21 also reaches its peak.

Subsequently, the residual toner Tr on the photoreceptor 21 which is to be moved back to the developer unit according to the theory of the reversal development does not completely fly to the developer unit after the reversal development since the amount of the residual toner Tr is too large as described above. Namely, a part of the toner Tr remains on the photoreceptor 21. When the amount of the residual toner Tr flying to the developer unit reaches its peak, this phenomenon becomes particularly significant, and the amount of the residual toner Tr on the photoreceptor 21 after the reversal development also becomes peak. As discussed above, since the amount of the residual toner Tr on the photoreceptor 21 after the reversal development is also increased and decreased in synchronism with the cycle of the alternating current, the residual toner Tr forms a pattern on the photoreceptor 21. .This pattern is transferred in the transferring step. As a result, a so-called fog occurs. The fog is a phenomenon in which vertical black stripes running in the paper transport direction appear on an output white image as shown in FIG. 10. The black stripes appear in synchronism with a cycle that can be calculated by the peripheral velocity of the photoreceptor 21. On the other hand, if a grayish image is output, small white stripes running perpendicularly to the paper transport direction appear over a wide area. This phenomenon is called a white missing defect.

The above-mentioned image forming apparatus which is capable of recycling the residual toner and uses a contact-type charger as the charging device can never form a quality image by simply combining conventional means and conventional methods.

Moreover, in the contact-type charging device, particularly, a brush-type charger, it is hard to impart a uniform electric potential to the surface of the photoreceptor. Consequently, an electrostatic latent image to be formed is disturbed, and the image quality is degraded.

More specifically, in the brush-type charger, since the shape of the brush section which comes into contact with the photoreceptor surface to perform charging and the electric characteristics (for example, resistance and dielectric constant) thereof are not uniform, it is impossible to uniformly charge the photoreceptor surface. In particular, when viewing the photoreceptor surface from a direction perpendicular to the paper transport direction, the amount of increase and decrease in the charge potential becomes significant. Therefore, when the charge potential of the photoreceptor surface is not uniform, small white stripes running parallel to the paper transport direction, i.e., a so-called white missing defect appears on a formed black image as shown in FIG. 11, resulting in a lowering of the image quality. This phenomenon is particularly significant when only a DC voltage is applied to the charger.

SUMMARY OF THE INVENTION

It is the first object of the present invention to provide a small-sized image forming apparatus with high maintainability which is capable of recycling developer and producing image with high image quality.

In order to achieve the first object, an image forming apparatus of the present invention includes:

- an image carrier for holding a developer image on a surface thereof;
- charging means for charging the surface of the image carrier;
- exposing means for forming an electrostatic latent image by exposing the charged surface of the image carrier;
- developing and cleaning means for collecting residual developer remaining on the surface of the image carrier after a transfer operation, and applying developer to the electrostatic latent image so as to form a developer image;
- transferring means for transferring the developer image to a transfer material; and
- developer scattering means for scattering the residual developer before the residual developer moves to an exposure position from a charging position.

In this structure, the residual developer remaining on the surface of the image carrier after the transfer operation goes through the charging step, and is then scattered by the developer scattering means before the residual toner moves to the exposure position from the charging position so that the accumulation density thereof is lowered. Therefore, in an image forming apparatus adopting a cleaningless process using developing and cleaning means, even if a contact-type charger is used as charging means and the residual developer is patterned on the surface of the image carrier by the contact-type charger, the pattern of the residual developer is scattered and evenly spread before the residual toner reaches the exposure position, thereby achieving satisfactory exposure. It is thus possible to prevent such a problem that the pattern of the residual developer formed as a memory image by the charging means affects the next image and lowers the image quality. Consequently, the image quality is improved.

Moreover, in a conventional image forming apparatus adopting the cleaningless process, if a contact-type charger is used and if an AC voltage is applied to the charger, the amount of the residual toner flying from the charger to the image carrier is increased and decreased in synchronism with the cycle of the AC voltage. Therefore, if the amount of the developer accumulated on the image carrier becomes excessively large, the residual developer on the image carrier which is to be moved back to the developing and cleaning means according to the theory does not completely fly to the developing and cleaning means. Namely, a part of the residual developer remains on the image carrier. As a result, a so-called fog, i.e., black stripes running in a direction perpendicular to the paper transport direction appear on an output white image. Alternatively, when a grayish image is output, white stripes running in the direction perpendicular to the paper transport direction appear as a white missing defect over a wide range.

On the other hand, in the above-mentioned structure of the present invention, even if a contact-type charger is used in the image forming apparatus adopting the cleaningless process and even if an AC voltage is applied to the charger, a large amount of the accumulated residual developer is scattered and evenly spread by the developer scattering means. It is thus possible to efficiently collect the residual toner from the image carrier. As a result, the generation of the above-mentioned fog and white missing defect is prevented, improving the image quality.

In this structure, the developer scattering means preferably includes a holding section which catches and holds the residual developer, and controlling means which controls the residual developer which has been temporarily held by the holding section to move back to the image carrier during non-imaging.

The residual developer on the image carrier is caught and temporarily held by the holding section during imaging, and then returns to the image carrier during non-imaging. The residual developer which has returned to the image carrier is collected by the developing and cleaning means and reused for the next imaging operation. Therefore, the surface of the image carrier has no residual developer as if the residual developer is collected by a cleaning device when performing the exposure of the surface of the image carrier by the exposing means. It is thus possible to perform more satisfactory exposure without using a large cleaning device with low maintainability like a conventional cleaning device. In addition, since the residual developer held by the holding section is moved back to the image carrier by the controlling means during non-imaging, the exposure can never be interrupted by the returned residual developer. Accordingly, the image quality is further improved.

Furthermore, with the above-mentioned structure, the holding section in the developer scattering means is a contact scattering and catching member which comes into contact with the surface of the image carrier so as to scatter, catch and hold the residual developer, and the controlling means therein is voltage applying means which applies to the contact Scattering and catching member a voltage of the same polarity as the developer so that the charge potential of the image carrier becomes higher than the charge potential of the developing and cleaning means.

In this structure, the contact scattering and catching member comes into contact with the image carrier, removes the residual developer from the surface of the image carrier using a mechanical function, and causes the removed residual developer to adhere to the surface of the contact scattering and catching member. When a voltage of the same polarity as the developer is applied to the contact scattering and catching member by the voltage applying means, the residual developer adhering to the surface of the contact scattering and catching member is returned to the image carrier using an electric repulsive force between the contact scattering and catching member and the residual developer. The voltage applied to the contact scattering and catching member by the voltage applying means has a value which makes the charge potential of the image carrier higher than the charge potential of the developing and cleaning means. Therefore, when performing development in the exposure Section, the developer which has returned to the image carrier moves back to the developing and cleaning means because of the potential difference between the image carrier and the developing and cleaning means. It is thus possible to reuse the developer. Consequently, the image quality can be more easily and surely improved.

It is the second object of the present invention to provide a small-sized image forming apparatus which consumes less power, is preferable for the protection of public health, and capable of producing an image with high quality.

In order to achieve the second object, an image forming apparatus of the present invention includes:

an image carrier for holding a developer image on a surface thereof;

charging means for charging the surface of the image carrier;

exposing means for forming an electrostatic latent image by exposing the charged surface of the image carrier;

developing means for applying developer to the electrostatic latent image so as to form a developer image;

transferring means for transferring the developer image to a transfer material; and charge potential correcting means for correcting a charge potential of the image carrier to a desired charge potential, wherein the charge potential correcting means includes a second conducting contact member which comes into contact with the surface of the image carrier before the surface of the image carrier moves to an exposure position from a charging position, and second voltage applying means for applying to the second contact member a voltage which is lower than the desired charge potential of the image carrier by an amount corresponding to a charging start voltage when the charging means charges the image carrier.

In this structure, the charge potential correcting means includes the second conducting contact member which comes into contact with the surface of the image carrier before the surface of the image carrier moves to the exposure position from the charging position, and the second voltage applying means for applying to the second contact member a voltage which is lower than the desired charge potential of the image carrier by an amount corresponding to the charging start voltage when the charging means charges the image carrier. Accordingly, a voltage difference which is not smaller than the charging start voltage is generated between the second contact member to which the above-mentioned voltage has been applied by the second voltage applying means and the image carrier. Thus, charging (or discharging) is performed from the one having a higher voltage to the other having a lower voltage because of a voltage difference which is not lower than the charging start voltage between the second contact member and the image carrier. Therefore, even if the electric potential of the surface of the image carrier which has been charged by the charging means is not uniform, a locally high electric potential on the surface of the image carrier is discharged to a desired electric potential, thereby correcting the nonuniformity of the electric potential on the surface of the image carrier.

With this arrangement, when a brush-like charger is used as the charging means, if the shape and the electric characteristics (for example, resistance and dielectric constant) of the brush section which comes into contact with the image carrier to perform charging are not uniform, it is possible to prevent a white missing defect, i.e., small white stripes running parallel to the paper transport direction on a black image, thereby improving the image quality.

In this structure, the developing means is preferably developing and cleaning means which collects the residual developer remaining on the surface of the image carrier after the transfer operation and develops the electrostatic latent image into a developer image by applying the developer thereto. Additionally, in this structure, the second contact member is preferably a contact scattering member which comes into contact with the surface of the image carrier and scatters the residual developer.

The first object mentioned above can also be achieved by this structure. More specifically, in this structure, the residual developer remaining on the surface of the image carrier after the transfer operation is scattered between the charging position and the exposure position by the contact scattering member after the charging step, and thus the accumulation density is lowered. Accordingly, in an image forming apparatus adopting the cleaningless process using the developing and cleaning means, even when a contact-type charger is used as the charging means and when a pattern of the residual developer is formed on the surface of the image carrier by the contact-type charger, the pattern of the residual toner is scattered and evenly spread before reaching the exposure position, thereby performing satisfactory exposure. It is thus possible to prevent the pattern of the residual developer formed as a memory image by the charger from affecting the next image and lowering the image quality. As a result, the image quality is improved.

For a fuller understanding of the nature and advantages of the invention, reference should be made to the ensuing detailed description taken in conjunction with the accompanying drawings.

PREFERRED EMBODIMENTS OF THE INVENTION

[Embodiment 1]

Figure 1:
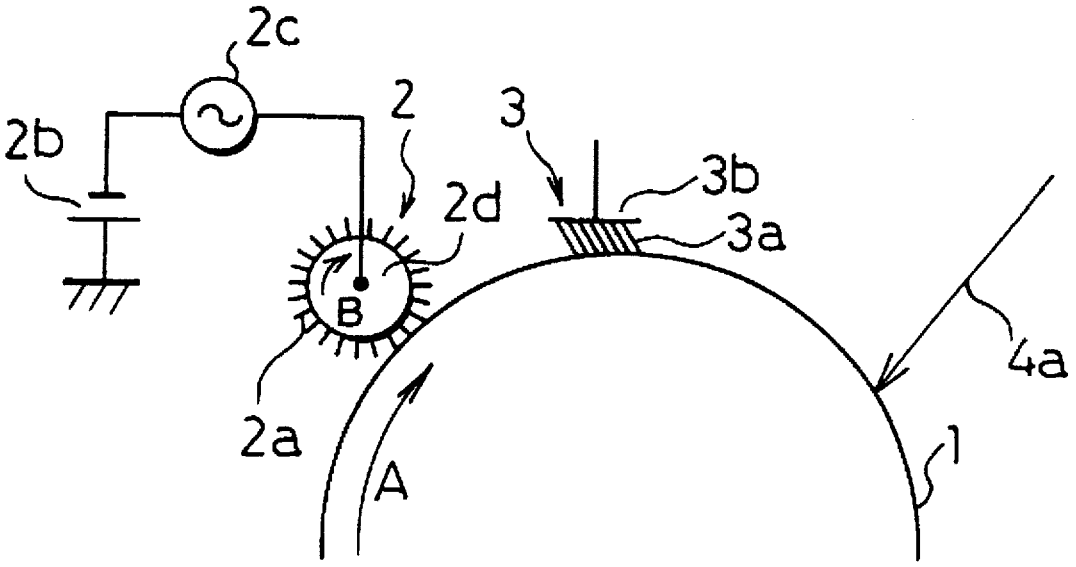
FIG. 1 is a depiction illustrating the relation among a charger, a toner scattering and catching member, and a write head in a laser beam printer as an image forming apparatus according to Embodiment 1 of the present invention.
Figure 2:
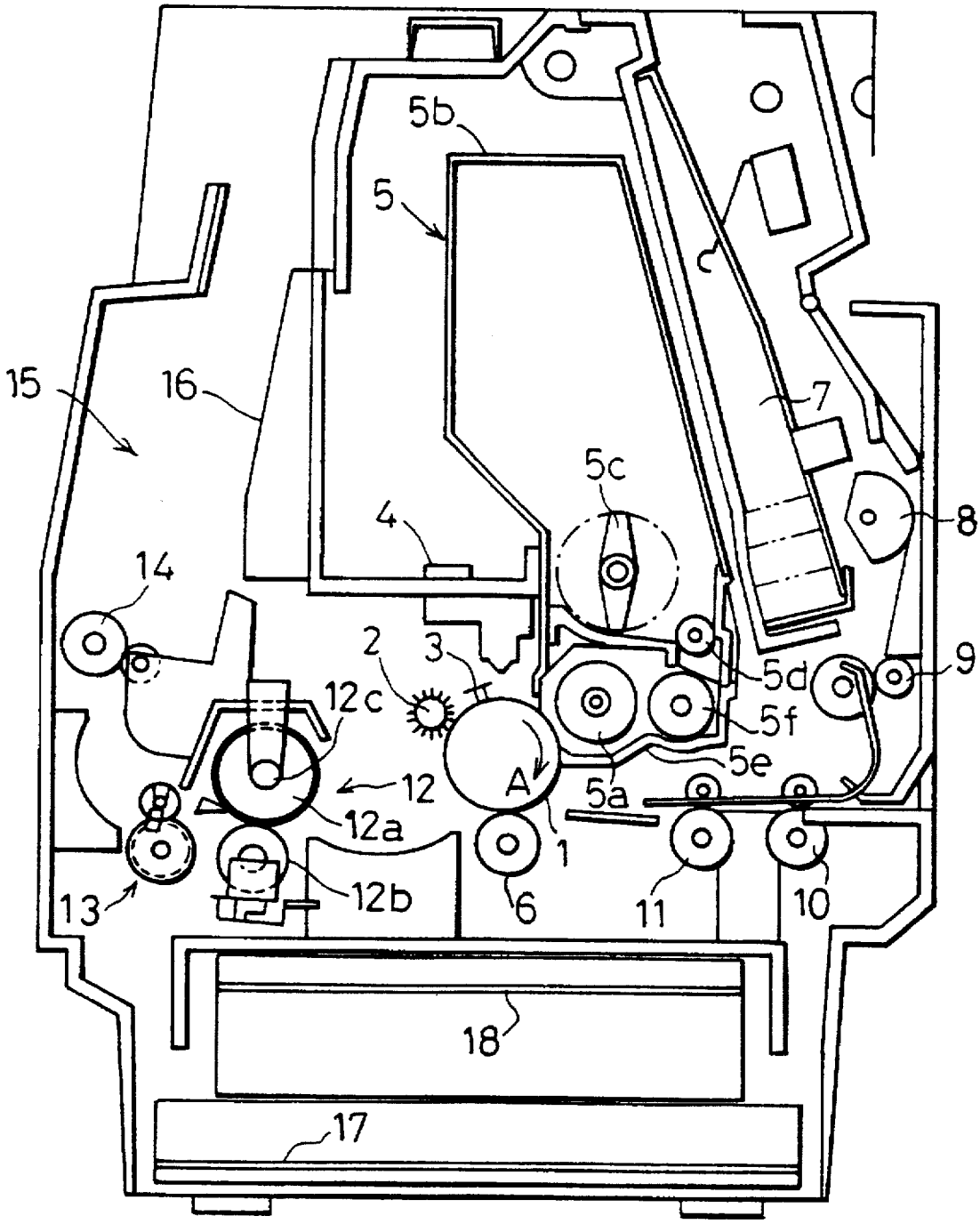
FIG. 2 is a view schematically showing the structure of the laser beam printer as the image forming apparatus related to all of the embodiments of the present invention.

The following description discusses one embodiment of the present invention with reference to FIGS. 1 and 2.

As illustrated in FIG. 2, a laser beam printer as an image forming apparatus of this embodiment includes a drum-shaped photoreceptor (image carrier) 1 at a substantially center section therein. The photoreceptor 1 is rotatable in the direction of arrow A. For example, the photoreceptor 1 is formed by an organic material. Disposed around the photoreceptor 1 are a charger (charging means) 2, a toner scattering and catching member (developer scattering means) 3, a write head (exposing means) 4, a developing and cleaning device (developing and cleaning means, and developing means) 5, and a transfer roller (transferring means) 6. These members are arranged in this order in the rotating direction of the photoreceptor 1.

The charger 2 charges the surface of the photoreceptor 1 to a predetermined electric potential. As illustrated in FIG. 1, a roller-shaped brush-type charger is used as the charger 2 in this embodiment. The charger 2 is rotatable in the direction of arrow B, and a brush section (first contact member) **2*a* arranged around a conducting roller 2*d* is formed by conducting fiber, for example, rayon fiber (produced by Unitika Ltd.) in which conducting carbons are dispersed. A negative voltage generated by superimposing an AC voltage from an AC power source 2*c* on a DC voltage from a DC power source 2*b* is applied to the charger 2. When the tip of the brush section 2*a* comes into contact with the surface of the photoreceptor 1, the photoreceptor 1** is charged in negative polarity.

The toner scattering and catching member 3 scatters toner remaining on the surface of the photoreceptor 1 (hereinafter referred to as the residual toner) after a recording medium passes through the transfer roller 6, and temporarily holds the toner. The toner scattering and catching member 3 performs only scattering in some cases. The shape of the toner scattering and catching member 3 is like a long, narrow, flat brush extending in the direction of the rotation axis of the photoreceptor 1. More specifically, the toner scattering and catching member 3 is formed into a shape like a flat brush by attaching the brush section **3*a* made of conducting fiber which is similar to that used for the brush section 2*a* of the charger 2 to a belt-like conducting substrate 3*b* whose length is equal to the dimension in the direction of the rotation axis of the photoreceptor 1. When the tip of the brush section 3*a* slides over the surface of the photoreceptor 1, it scatters, catches and temporarily holds the residual toner. Thus, by forming the toner scattering and catching member 3 into a flat brush shape, it is possible to catch and temporarily hold the residual toner. In this embodiment, the toner scattering and catching member 3 is insulated from members other than the photoreceptor 1, and is electrically in a floating state. Namely, although the brush section 3a is formed by a conducting material. This brush section 3a made of the conducting material does not differ from the brush section 3a** formed by an insulating material.

The write head 4 performs exposure by irradiating laser light 4a on the surface of the photoreceptor 1 which has been charged to the predetermined potential by the charger 2 so as to form an electrostatic latent image.

The developing and cleaning device 5 develops the electrostatic latent image formed on the surface of the photoreceptor 1 by supplying the toner to the electrostatic latent image, and collects unnecessary residual toner on the photoreceptor 1. Disposed in the developing and cleaning device 5 is a magnet roller 5a which transports the toner to a development region, i.e., a position facing the photoreceptor 1. The toner is agitated by an agitating blade 5c in a toner tank 5b, and suitably supplied to the developer vessel 5e by a supply roller 5d. After the toner is agitated by an agitating roller 5f, it is carried on the magnet roller 5a. The toner is then transported to the development region by a rotation of the magnet roller 5a. The magnet roller 5a has a function of collecting up the residual toner on the photoreceptor 1 in the developer vessel 5e. Therefore, a bias voltage of the same polarity as the charge potential of the photoreceptor 1 is applied to the magnet roller 5a by a power source, not shown.

The transfer roller 6 transfers a toner image formed on the surface of the photoreceptor 1 by the development onto paper as a recording medium. A positive voltage is applied to the transfer roller 6.

A paper cassette 7 is installed on one side (the right side in FIG. 2) of the developing and cleaning device 5. A feed roller 8, transport rollers 9 and 10, and a register roller 11 are disposed between the paper cassette 7 and the photoreceptor 1 so as to transport the paper to the photoreceptor 1.

A fusing device 12, transport rollers 13 and 14, and a paper output section 15 are disposed on the other side opposite to the paper transport side with respect to the photoreceptor 1 (the left side in FIG. 2). The fusing device 12 includes a heat roller 12a incorporating a heater 12c therein, and a pressure roller 12b. When the paper is transported from the transfer roller 6, the fusing device 12 nips the paper between the rollers 12a and 12b and transports the paper while fusing the toner on the paper. The paper carrying the toner fused thereon, i.e., carrying an image formed thereon, is output to the paper output section 15 by the transport rollers 13 and 14. The paper output section 15 includes a stack guide 16, and stacks and stores the output paper.

A controller 17 and an engine controller 18 are disposed in the lower part of the laser beam printer. The controller 17 performs processing necessary for imaging in the laser beam printer on image data transmitted from a host computer, not shown. When a signal instructing the start of imaging is input by the host computer, the engine controller 18 controls the operations of the respective sections so as to perform the instructed processing.

The following description will explain the imaging operation in the laser beam printer having the above-mentioned structure.

When a signal instructing the start of imaging is input, the photoreceptor 1 starts to rotate in the direction of arrow A. Meanwhile, a negative voltage generated by superimposing an AC voltage having a peak-to-peak voltage of 700 (V) and a frequency of 50 Hz from the AC power source 2c on a DC voltage of −750 (V) from the DC power source 2b is applied to the charger 2. When the brush section 2a of the charger 2 rotates in the direction of arrow B while making contact with the surface of the photoreceptor 1, the surface of the photoreceptor 1 is substantially uniformly charged to −600 (V).

When the charged area of the surface of the photoreceptor 1 passes through the toner scattering and catching member 3 and reaches the write head 4, the laser light 4a corresponding to the image information is irradiated to perform exposure. As a result, the surface potential is lowered and an electrostatic latent image is formed in the irradiated area of the photoreceptor 1.

In the developing and cleaning device 5, the negative toner is supplied to the area where the electrostatic latent image is formed from the magnet roller 5a to which a bias voltage of −300 (V) is applied. The voltage of −300 (V) applied to the magnet roller 5a is sufficient for causing the negative toner to fly from the magnet roller 5a toward the area of the photoreceptor 1 where the surface potential has been lowered, i.e., toward the electrostatic latent image. Accordingly, the toner adheres to the electrostatic latent image on the surface of the photoreceptor 1, and forms a toner image.

The toner image thus formed is transferred to paper, which is timely supplied from the register roller 11, by the transfer roller 6 to which a voltage of the opposite polarity to the toner, i.e., a positive voltage is applied. The supplied paper is the paper which was fed from the paper cassette 7 by the feed roller 8, transported by the transport rollers 9 and 10, and held by the register roller 11.

The paper to which the toner image has been transferred is processed in the fusing device 12, and then transported to the paper output section 15 by the transport rollers 13 and 14.

Meanwhile, the entire surface of the photoreceptor 1 is irradiated with a charge removing lamp, not shown, so as to remove charges. The first imaging process is completed with this operation. At this time, the toner which was not transferred by the transfer roller 6 remains as the residual toner on the surface of the photoreceptor 1.

Subsequently, when a signal instructing the start of the second imaging operation is input, similarly to the above, the photoreceptor 1 starts to rotate. At this time, when an area of the photoreceptor 1 where the residual toner is present reaches the charger 2, the residual toner comes into contact with brush section 2a of the charger 2, is mechanically scraped off with the rotation of the charger 2 in the direction of arrow B, and adheres to the brush section 2a. Thereafter, power is supplied to the charger 2, and the brush section 2a is charged in the negative polarity. At this time, the residual toner adhering to the brush section 2a is brought back to the photoreceptor 1. The reason for this is that since the brush section 2a is charged in the negative polarity and becomes the same polarity as the residual toner by the supply of power to the charger 2, an electric repulsive force is generated between the brush section 2a and the residual toner. The repulsive force becomes maximum at the moment the power is supplied to the charger 2. Therefore, a larger amount of the residual toner adhering to the charger 2 flies toward the photoreceptor 1.

Then, when the pattern formed by the residual toner on the photoreceptor 1 reaches the toner scattering and catching member 3, the pattern of the residual toner comes into contact with the brush section 3a of the toner scattering and catching member 3, is scattered, mechanically scraped off, adheres to and is held by the brush section 3a. Thus, the residual toner on the photoreceptor 1 is removed.

Subsequently, the laser light 4a is irradiated on the photoreceptor 1 according to the image information so as to perform exposure, and an electrostatic latent image is formed by the write head 4. At this time, since no residual toner is present on the photoreceptor 1, the exposure is satisfactorily performed.

In the developing and cleaning device 5, the negative toner supplied from the magnet roller 5a adheres to the electrostatic latent image and forms a toner image. The toner image is transferred to paper by the transfer roller 6.

As described above, in the laser beam printer of this embodiment, the pattern of the residual toner formed on the photoreceptor 1 by the charger 2 is scattered and the accumulation density is lowered by the toner scattering and catching member 3, located between the charger 2 and the exposure position of the write head 4 on the periphery of the photoreceptor 1, for scattering the residual toner adhering to the photoreceptor 1. Therefore, even if the contact-type charger 2 is used in an image forming apparatus adopting a cleaningless process using no cleaning device like the laser beam printer of this embodiment and if the residual toner is accumulated and patterned on the surface of the photoreceptor 1 by the contact-type charger 2, the pattern of the residual toner is uniformly scattered and spread before reaching the exposure position of the write head 4. Consequently, the exposure is satisfactorily performed.

It is thus possible to prevent the pattern of the residual toner formed by the charger 2 from becoming a memory image and affecting the next image, avoiding a lowering of the image quality. As s result, an image with satisfactory image quality can be obtained.

Moreover, when the contact-type charger 2 is used in an image forming apparatus adopting the cleaningless process and when an AC voltage is applied to the charger 2, the amount of the residual toner flying from the charger 2 toward the photoreceptor 1 is increased and decreased in synchronism with the cycle of the AC voltage. In this case, when the amount of toner accumulated on the photoreceptor 1 becomes excessively large, the residual toner on the photoreceptor 1 which is to be brought back to the developing and cleaning device 5 according to the theory, does not completely fly to the developing and cleaning device 5. As a result, a part of the residual toner remains on the photoreceptor 1 and black stripes running in a direction perpendicular to the paper transport direction appear on an output white image, i.e., a so-called fog occurs. On the other hand, when a grayish image is output, a white missing defect or white strips running in a direction perpendicular to the paper transport direction sometimes appear over a wide range. However, since the pattern formed by such a large accumulation of the residual toner is scattered and uniformly spread by the toner scattering and catching member 3, the residual toner can be efficiently collected from the photoreceptor 1. As a result, the generation of the above-mentioned fog and white missing defect is reduced, and an image with satisfactory image quality can be obtained.

Furthermore, the toner scattering and catching member 3 of this embodiment not only scatters the toner, but also scatters, catches, and temporarily holds the residual toner adhering to the photoreceptor 1. Therefore, until the residual toner increases and overflows, the surface of the photoreceptor 1 has no residual toner as if the residual toner accumulated and held in the brush section 3a of the toner scattering and catching member 3 is collected by a cleaning device. It is therefore possible to perform exposure more satisfactorily and improve the image quality.

[Embodiment 2]

Figure 3:
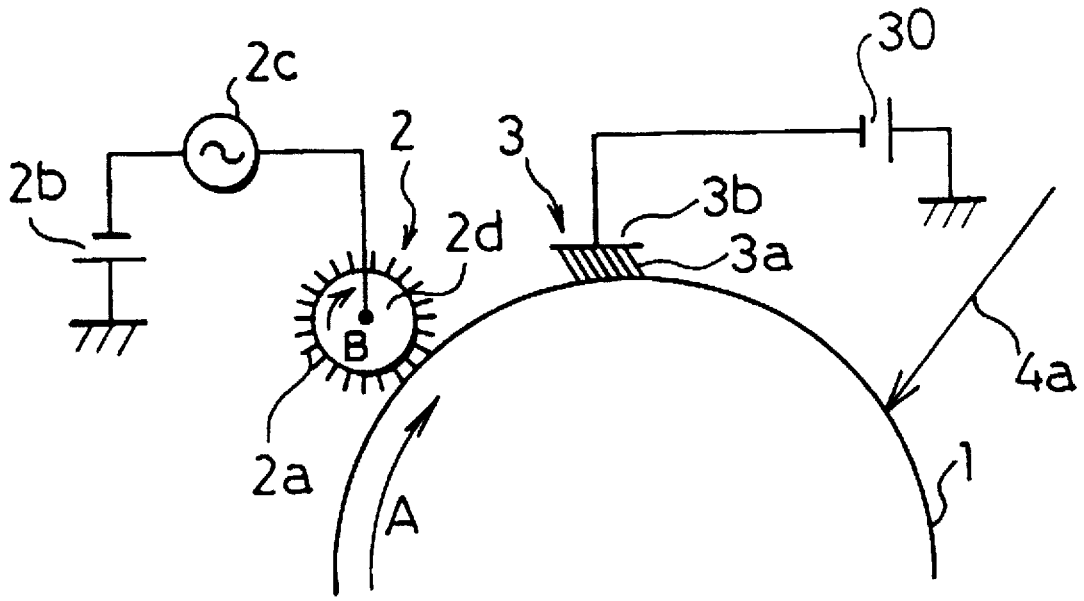
FIG. 3 is a depiction illustrating an example of the relation among a charger, a toner scattering and catching member, and a write head in a laser beam printer as an image forming apparatus according to Embodiment 2 of the present invention.
Figure 4:
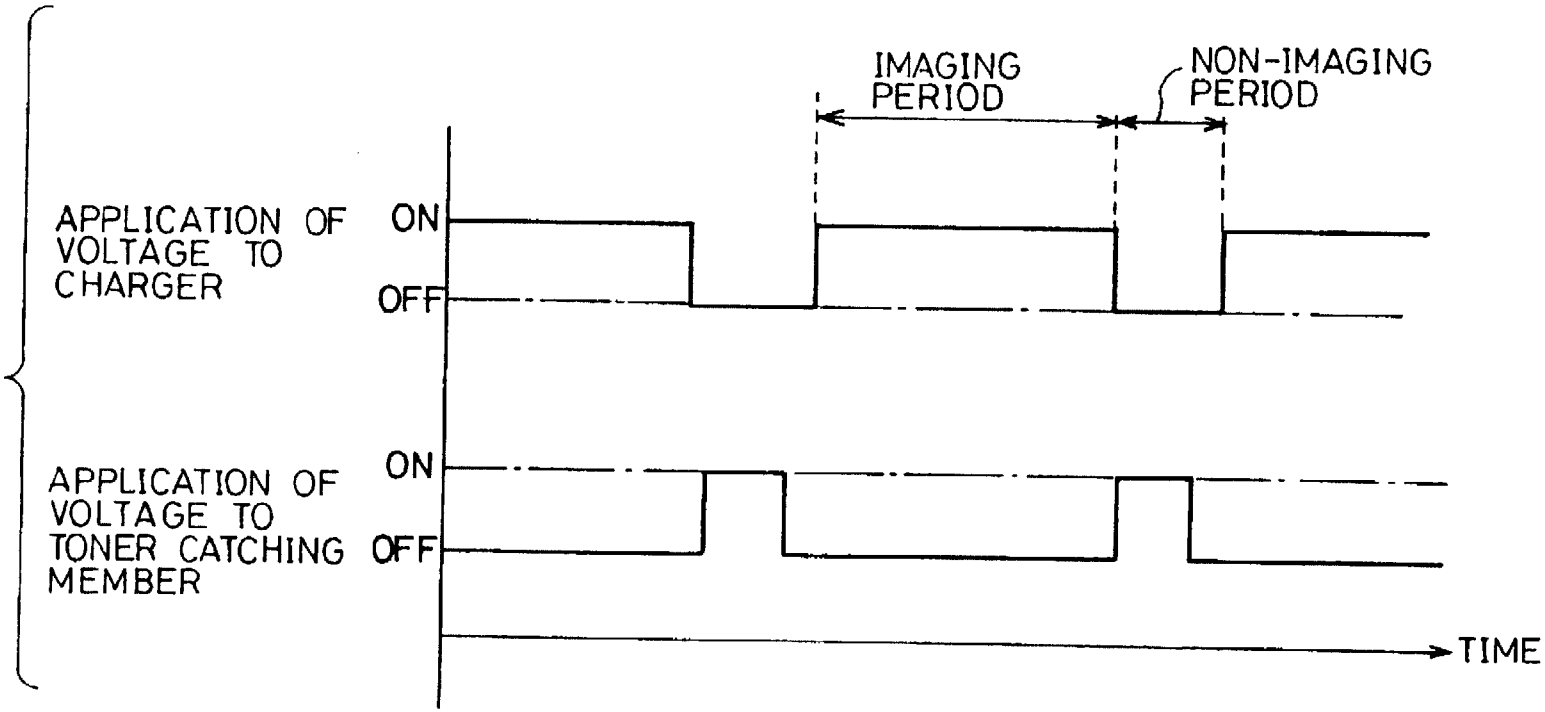
FIG. 4 is a timing chart showing the state of a voltage applied to the charger and the toner scattering and catching member in the laser beam printer of FIG. 3.
Figure 5:
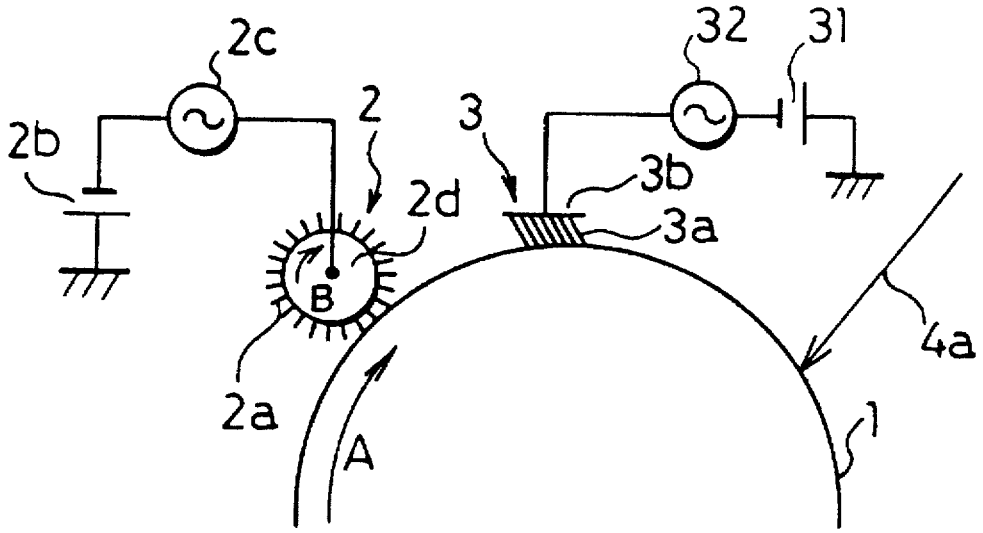
FIG. 5 is a depiction illustrating another example of the relation among the charger, the toner scattering and catching member, and the write head in the laser beam printer as an image forming apparatus according to Embodiment 2 of the present invention.

The following description will discuss another embodiment of the present invention with reference to FIGS. 3 to 5. The members having the same function as in Embodiment 1 will be designated by the same code and their description will be omitted.

In the laser beam printer of Embodiment 1, for example, when images are continuously printed on 100 sheets, faulty black stripes and white missing portions sometimes appear on white images and grayish images, respectively. It is considered that these phenomena are caused by an increase and overflowing of the residual toner accumulated and held by the brush section 3a of the toner scattering and catching member 3.

Whereas in a laser beam printer as an image forming apparatus of this embodiment, as illustrated in FIG. 3, a DC power source (first voltage applying means) 30 is connected to the toner scattering and catching member 3, and a voltage equal to the surface potential of the photoreceptor 1 is applied to the toner scattering and catching member 3 between the formation of an image on a sheet and the formation of an image on the next sheet. Except for this difference, the structure of the laser beam printer of this embodiment is the same as the laser beam printer of Embodiment 1.

The image forming operation of the image forming apparatus having such a structure will be explained below. When a signal instructing the start of imaging is input, the photoreceptor 1 starts to rotate in the direction of arrow A. At this time, if the residual toner is present on the photoreceptor 1, the residual toner comes into contact with and is caught by the brush section 2a of the charger 2. A negative voltage generated by superimposing an AC voltage having a peak-to-peak voltage of 700 (V) and a frequency of 50 Hz from the AC power source 2c on a DC voltage of −750 (V) from the DC power source 2b, is applied to the charger 2. As a result, the surface of the photoreceptor 1 which is in contact with the charger 2 is charged to −900 (V). In this case, the residual toner caught by the brush section 2a of the charger 2 flies to the photoreceptor 1 because of an electric repulsive force upon the supply of power to the charger 2, and forms the above-mentioned pattern. The amount of the residual toner to fly increases and decreases in synchronism with the cycle of the AC current applied to the charger 2.

When the charged area of the surface of the photoreceptor 1 reaches the toner scattering and catching member 3 located in a downstream section of the charger 2, the residual toner comes into contact with, is scattered, caught and held by the brush section 3a of the toner scattering and catching member 3.

In the write head 4, the laser light 4a corresponding to the image information is irradiated on the photoreceptor 1 to perform exposure. As a result, an electrostatic latent image is formed. In the developing and cleaning device 5, the toner is supplied from the magnet roller 5a to the electrostatic latent image so as to form a toner image. The toner image is then transferred to paper, and transported to the paper output section 15.

On the other hand, the photoreceptor 1 continues to rotate after passing through the charge removing lamp (post-rotation). The period of post-rotation is a non-imaging period which ends upon the input of the instruction signal to start the next imaging operation. The residual toner remaining after passing through the transfer roller 6 comes into contact with and adheres to the brush section 2*a* in the charger 2, and is removed from the photoreceptor 1.

In the non-imaging period, as illustrated in FIG. 4, even when the photoreceptor 1 reaches the charger 2, the surface thereof is not charged because no power is supplied to the charger 2. Therefore, the residual toner adhering to the brush section 2*a* of the charger 2 does not fly to the photoreceptor 1, and continues to be held by the brush section 2*a*.

In the next toner scattering and catching member 3, as described above, since most of the residual toner on the photoreceptor 1 is removed and held by the charger 2, it can hardly happen that the residual toner is newly caught. However, the residual toner caught in the previous imaging operation has already been accumulated in the brush section 3*a* of the toner scattering and catching member 3. Then, a DC voltage of −900 (V) which is equal to the surface potential of the photoreceptor 1 is applied to the toner scattering and catching member 3. As a result, the surface of the photoreceptor 1 which is in contact with the brush section 3*a* of the toner scattering and catching member 3 is charged, and exhibits an electric potential of −450 (V). Therefore, the residual toner which has been charged in the negative polarity and accumulated in the brush section 3*a* receives a larger electric repulsive force than an electric repulsive force against the surface of the photoreceptor 1 caused by the toner scatting and catching section 3, and flies to the photoreceptor 1. Thus, by supplying power to the toner scattering and catching member 3, a part of the residual toner adhering to and being accumulated in the brush section 3*a* is caused to fly to the photoreceptor 1 by the electric repulsive force.

When the surface of the photoreceptor 1 carrying residual toner thereon passes through the write head 4 and reaches the developing and cleaning device 5, it is charged to −450 (V) and faces the magnet roller 5*a* which has been charged to −300 (V). At this time, since the charge potential of the photoreceptor 1 is higher than the charge potential of the magnet roller 5*a*, the residual toner which is carried on the photoreceptor 1 and charged in the negative polarity flies toward the magnet roller 5*a*, and is then brought back to and collected in the developer vessel 5*e*.

As described above, in the laser beam printer of this embodiment, since the voltage equal to the surface potential of the photoreceptor 1 is applied to the toner scattering and catching member 3 only during the non-imaging period, it is possible to collect the residual toner accumulated in the toner scattering and catching member 3 in the developer vessel 5*e* within the non-imaging period between the image formation on a sheet and the image formation on the next sheet during which the image quality is not affected. It is thus possible to reuse the collected residual toner. Therefore, in addition to the effect produced by the structure of Embodiment 1, the structure of this embodiment prevents the residual toner from overflowing the toner scattering and catching member 3 in the imaging step. Accordingly, it is possible to prevent defective phenomena, for example, the appearance of black stripes on a white image and white missing portions on a grayish image, and to obtain an image with further improved image quality.

In this embodiment, the voltage equal to the surface potential of the photoreceptor 1 is applied to the toner scattering and catching member 3. However, the present invention is not necessarily limited by this structure. Namely, it is only necessary to arrange the photoreceptor 1 after passing through the toner scattering and catching member 3 to have a surface potential higher than the surface potential of the magnet roller 5*a* of the developing and cleaning device 5.

Moreover, in this embodiment, a predetermined DC voltage is applied only during the non-imaging. However, an effect similar to that of this embodiment can be obtained by, for example, connecting a DC power source 31 and an AC power source 32 as first voltage applying means to the toner scattering and catching member 3 as shown in FIG. 5 and applying a voltage, for example, a negative voltage which is generated by superimposing an AC voltage having a peak-to-peak voltage of 400 (V) and a frequency of 50 Hz on a DC voltage of −400 (V) to the toner scattering and catching member 3 only during the non-imaging so that the surface potential of the photoreceptor 1 after passing through the toner scattering and catching member 3 becomes higher than the surface potential of the magnet roller 5*a* of the developing and cleaning device 5.

[Embodiment 3]

Figure 6:
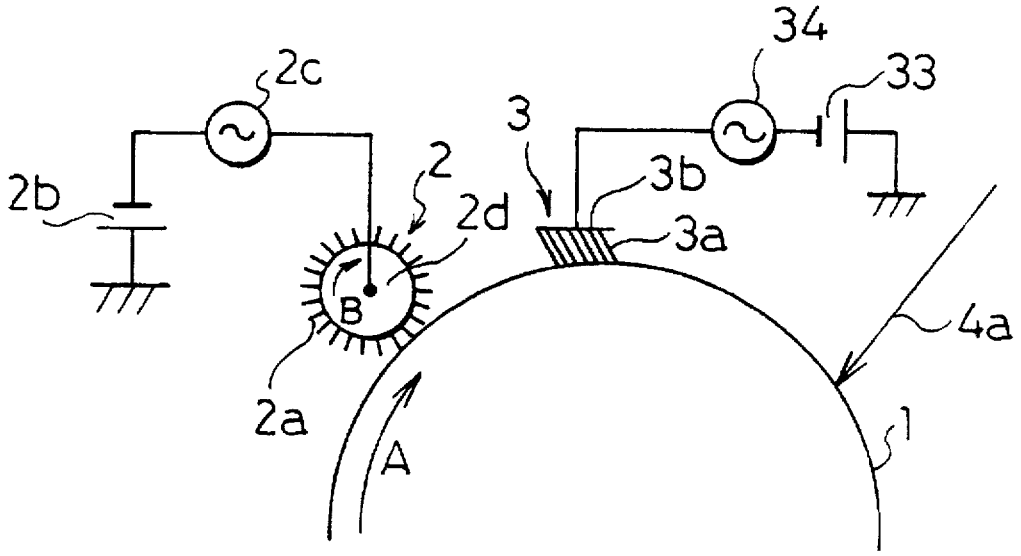
FIG. 6 is a depiction illustrating an example of the relation among a charger, a toner scattering and catching member, and a write head in a laser beam printer as an image forming apparatus according to Embodiment 3 of the present invention.
Figure 7:
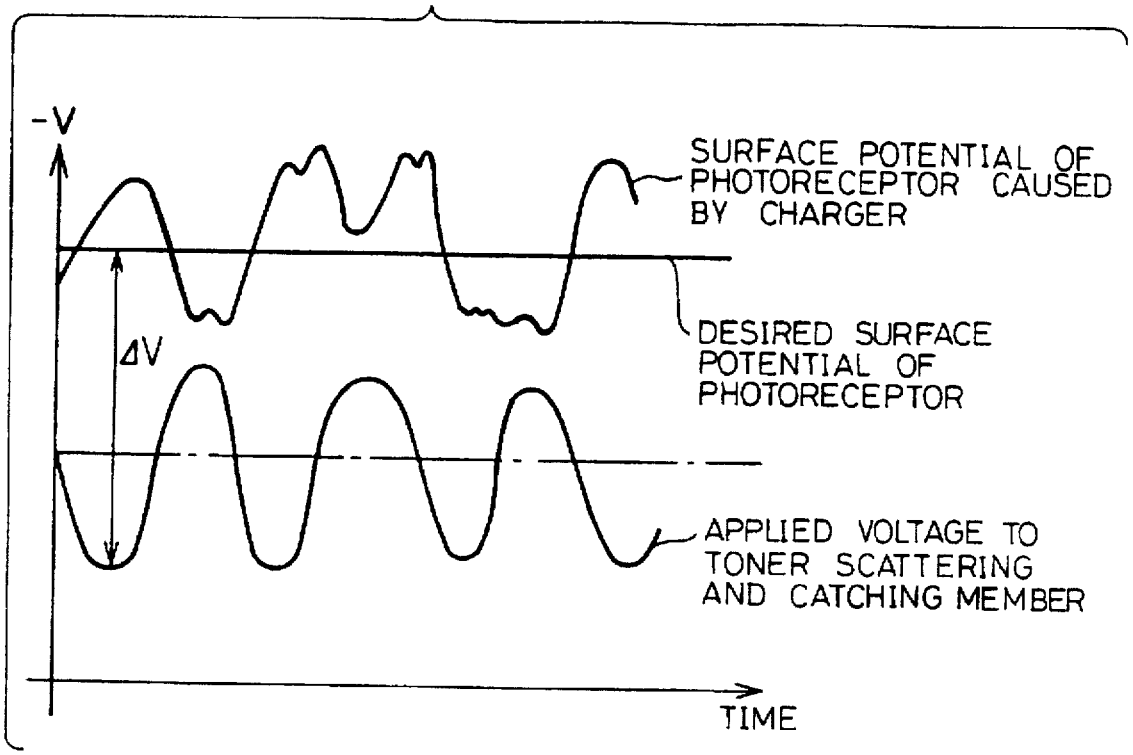
FIG. 7 is a characteristic view showing the relation among a surface potential of the photoreceptor caused by the charger, a desired surface potential thereof, and an applied voltage to the toner scattering and catching member.
Figure 8:
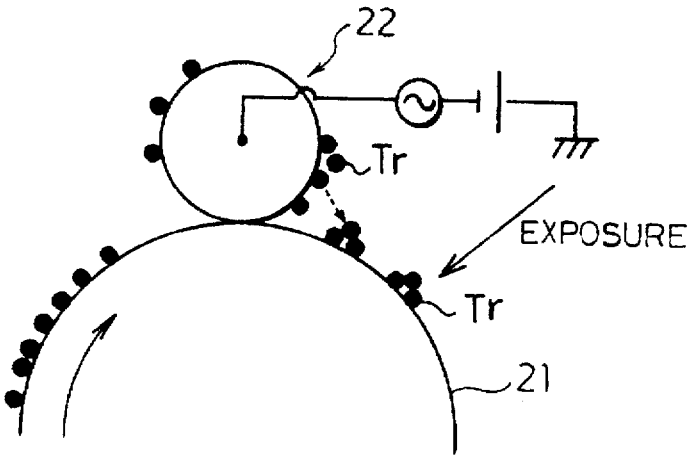
FIG. 8 is an explanatory view showing a state in which, after residual toner on a photoreceptor adheres to a charger, the toner is bounced to the photoreceptor and interrupts exposure in a conventional image forming apparatus.
Figure 9:
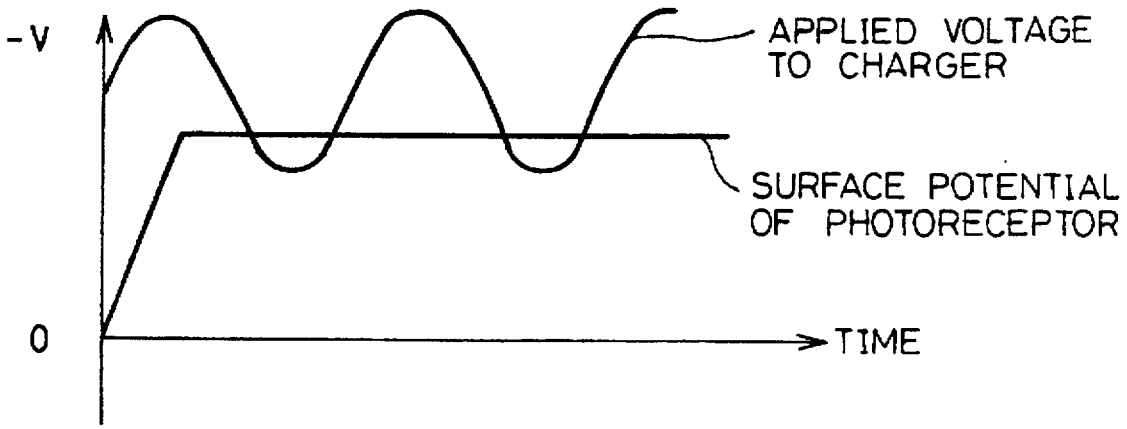
FIG. 9 is a characteristic view showing the relation between the applied voltage to the charger and the surface potential of the photoreceptor.
Figure 10:
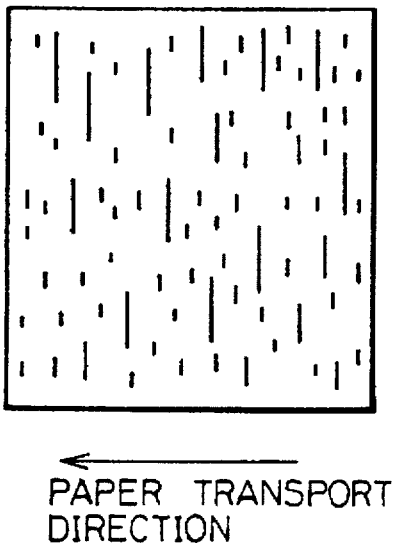
FIG. 10 is an explanatory view showing a fog appearing on an image output by a conventional image forming apparatus.
Figures 11A, 11B:
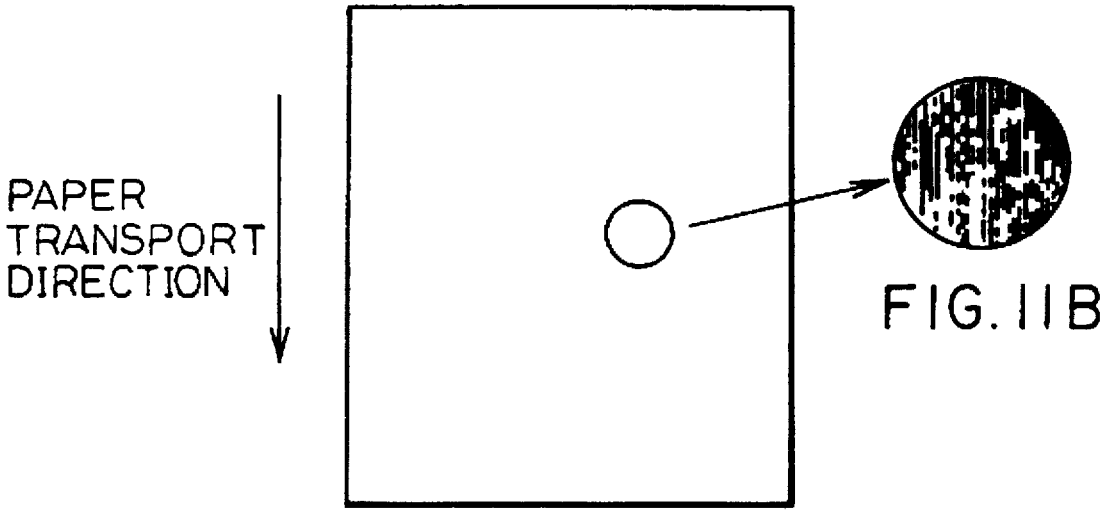
FIG. 11 is an explanatory view showing a white missing defect appearing on an image output by a conventional image forming apparatus.

The following description will discuss still another embodiment of the present invention with reference to FIGS. 6 and 7. The members having the same function as in Embodiments 1 and 2 will be designated by the same code and their description will be omitted.

In the laser beam printers of Embodiments 1 and 2, small faulty white stripes running parallel to the paper transport direction sometimes appear on a black image. This phenomenon is particularly significant when only the DC voltage is applied to the charger 2.

The white stripe is a phenomenon that occurs when an electric potential which is extraordinary higher than a desired charge potential is applied to a part of the surface of the photoreceptor 1 by the charger 2. In order to lower the extraordinary high potential to a desired potential, it is necessary to connect a DC power source 33 and an AC power source 34 as second voltage applying means to the toner scattering and catching member (second contact member) 3 located in a downstream section of the charger 2 as shown in FIG. 6. It is necessary to apply a voltage to the toner scattering and catching member 3 by the DC power source 33 and the AC power source 34, and correct the surface potential of the photoreceptor 1 by the toner scattering and catching member 3. In this case, the electric potential to be applied to the toner scattering and catching member 3 is an electric potential which is lower than the desired charge potential of the photoreceptor 1 by an amount corresponding to a charging start voltage. The charging start voltage is a value determined by the photoreceptor 1, the toner scattering and catching member 3 as well as the atmosphere that surrounds them (for example, the temperature and humidity), and is defined as the voltage applied to the toner scattering and catching member 3 when the photoreceptor 1 starts to be charged. The relation among the surface potential of the photoreceptor 1 caused by the charger 2, the desired surface potential, and the voltage applied to the toner scattering and and catching member 2, is shown in FIG. 7. In FIG. 7, $\Delta V$ is a discharging start voltage in the toner scattering and catching member 3.

For example, in a combination of the photoreceptor 1 (made of an 20-μm organic photosensitive layer), the charger 2 and the toner scattering and catching member 3 of this embodiment, it can be prescribed from the experimental result that the charging start voltage is substantially −450 (V) in the normal atmosphere. It is therefore only necessary to impart a DC potential of a value which is 450 (V) lower than a desired charge potential of the photoreceptor 1 to the toner scattering and catching member 3. In this case, since there is a higher probability that the AC voltage is discharged, the effect of correcting the charge potential of the photoreceptor 1 is strengthen by applying to the toner scattering and catching member 3 a voltage generated by superimposing the AC voltage on the DC voltage. In particular, the effect of correcting the charge potential of the photoreceptor 1 becomes stronger when the frequency of the superimposed AC voltage is high.

Therefore, in the laser beam printer as the image forming apparatus of this embodiment, as illustrated in FIG. 6, the toner scattering and catching member 3 is connected to the DC power source 33 and the AC power source 34, and a negative voltage which is produced by superimposing an AC voltage with a peak-to-peak voltage of 600 (V) and a frequency of 50 Hz on a DC voltage of 600 (V) is always applied to the toner scattering and catching member 3. Except for this difference, the laser beam printer of this embodiment has the same structure as that of the laser beam printer of Embodiment 2.

With the above-mentioned arrangement, in addition to the effects produced by Embodiments 1 and 2, it is possible to reduce the generation of white stripes on a black image, which reflect excessive charging in a small area and are caused by the nonuniformity in charging the photoreceptor 1, to a sufficient permissible level, thereby improving the image quality.

In the above-mentioned embodiments, the brush-like conducting toner scattering and catching member 3 is used. However, the material and shape of the toner scattering and catching member 3 are not particularly limited as long as it is capable of sliding over the surface of the photoreceptor 1 and scattering the residual toner. For example, it is possible to use a conducing sponge or a conducting blade. The toner scattering and catching member 3 is more preferably arranged in a shape capable of scattering, catching and holding the residual toner, for example, in the shape of a brush or sponge.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

an image carrier for holding a developer image on a surface thereof;

charging means for charging the surface of said image carrier;

exposing means for forming an electrostatic latent image by exposing the charged surface of said image carrier;

developing and cleaning means for collecting residual developer remaining on the surface of said image carrier after a transfer operation, and applying developer to the electrostatic latent image so as to form a developer image;

transferring means for transferring the developer image to a transfer material; and developer scattering means, provided separately from said charging means, for scattering the residual developer before the surface of said image carrier moves to an exposure position from a charging position.

2. The image forming apparatus as set forth in claim 1, wherein said developer scattering means includes a contact scattering member which comes into contact with the surface of said image carrier to scatter the residual developer.

3. The image forming apparatus as set forth in claim 2, wherein said contact scattering member is a contact scattering and catching member which comes into contact with the surface of said image carrier to scatter and catch the residual developer.

4. The image forming apparatus as set forth in claim 3, wherein said contact scattering and catching member is insulated from members other than said image carrier at least during imaging.

5. The image forming apparatus as set forth in claim 3, wherein said contact scattering and catching member is a brush section whose tip comes into contact with the surface of said image carrier to scatter and catch the residual developer.

6. The image forming apparatus as set forth in claim 5, wherein said developer scattering means further includes a flat substrate which supports said brush section.

7. The image forming apparatus as set forth in claim 5, wherein said contact scattering and catching member includes conducting fiber.

8. The image forming apparatus as set forth in claim 7, wherein said contact scattering and catching member includes rayon fiber in which conducting carbons are dispersed.

9. The image forming apparatus as set forth in claim 1, wherein said charging means is a contact-type charger which comes into contact with the surface of said image carrier and applies a voltage to the surface of said image carrier so as to charge the surface of said image carrier.

10. The image forming apparatus as set forth in claim 9, wherein said contact-type charger is a brush charger whose brush tip comes into contact with the surface of said image carrier so as to charge the surface of said image carrier.

11. The image forming apparatus as set forth in claim 10, wherein said contact-type charger is a roller-shaped brush charger including a conducting roller and hair implanted around said conducting roller.

12. The image forming apparatus as set forth in claim 11, wherein said image carrier is a rotating photoreceptor drum, and said brush charger is which rotates in a state in which a brush tip of said brush charger is in contact with the surface of said image carrier.

13. The image forming apparatus as set forth in claim 9, wherein said contact-type charger includes a first contact member which comes into contact with the surface of said image carrier, and superimposed voltage applying means for applying a voltage generated by superimposing an AC voltage on a DC voltage to said first contact member.

14. The image forming apparatus as set forth in claim 1, wherein said developing and cleaning means includes a magnet roller which carries developer, and transports the developer to a position facing said image carrier by rotation.

15. The image forming apparatus as set forth in claim 14, wherein said magnet roller has an electric potential of the same polarity as a charge potential of said image carrier.

16. The image forming apparatus as set forth in claim 1, wherein said developer scattering means includes a holding section for catching and holding the residual developer, and controlling means for controlling the residual developer which has been temporarily held on said holding section to be brought back to said image carrier during non-imaging.

17. The image forming apparatus as set forth in claim 16, wherein said holding section is a contact scattering and catching member which comes into contact with the surface of said image carrier, scatters catches and holds the residual developer, and said controlling means is first voltage applying means for applying to said contact scattering and catching member a voltage of the same polarity as the developer only during non-imaging so that a charge potential of said image carrier becomes higher than a charge potential of said developing and cleaning means.

18. The image forming apparatus as set forth in claim 17, wherein said contact scattering and catching member is insulated from members other than said image carrier during imaging.

19. The image forming apparatus as set forth in claim 17, wherein the voltage applied to said contact scattering and catching member by said first voltage applying means is a DC voltage.

20. The image forming apparatus as set forth in claim 17, wherein the voltage applied to said contact scattering and catching member by said first voltage applying means is a voltage generated by superimposing an AC voltage on a DC voltage.

21. An image forming apparatus comprising:

an image carrier for holding a developer image on a surface thereof;

charging means for charging the surface of said image carrier;

exposing means for forming an electrostatic latent image by exposing the charged surface of said image carrier;

developing means for applying developer to the electrostatic latent image so as to form a developer image;

transferring means for transferring the developer image to a transfer material; and charge potential correcting means for correcting a charge potential of said image carrier to a desired charge potential, wherein said charge potential correcting means includes a conducting second contact member which comes into contact with the surface of said image carrier before the surface of said image carrier moves to an exposure position from a charging position, and second voltage applying means for applying to said second contact member a voltage which is lower than the desired charge potential of said image carrier by an amount corresponding to a charging start voltage when said charging means charges said image carrier.

22. The image forming apparatus as set forth in claim 21, wherein the voltage applied to said second contact member by said second voltage applying means is a voltage generated by superimposing an AC voltage on a DC voltage.

23. The image forming apparatus as set forth in claim 21, wherein said developing means is developing and cleaning means for collecting residual developer remaining on the surface of said image carrier after a transfer operation, and applying developer to the electrostatic latent image so as to form a developer image.

24. The image forming apparatus as set forth in claim 21, wherein said second contact member is a contact scattering member which comes into contact with the surface of said image carrier to scatter the residual developer.

25. The image forming apparatus as set forth in claim 21, wherein said contact scattering member is a contact scattering and catching member which comes into contact with the surface of said image carrier to scatter and catch the residual developer.

26. The image forming apparatus as set forth in claim 25, wherein said contact scattering and catching member is a brush section whose tip comes into contact with the surface of said image carrier to scatter and catch the residual developer.

27. The image forming apparatus as set forth in claim 21, wherein said charging means is a contact-type charger which comes into contact with the surface of said image carrier and applies a voltage to the surface of said image carrier so as to charge the surface of said image carrier.

28. The image forming apparatus as set forth in claim 27, wherein said contact-type charger is a brush charger whose brush tip comes into contact with the surface of said image carrier so as to charge the surface of said image carrier.

29. The image forming apparatus as set forth in claim 27, wherein said contact-type charger includes a first contact member which comes into contact with the surface of said image carrier, and a superimposed voltage applying means for applying to said first contact member a voltage generated by superimposing an AC voltage on a DC voltage.

* * * * *